US008047976B2

(12) United States Patent
Holbrook et al.

(10) Patent No.: US 8,047,976 B2
(45) Date of Patent: Nov. 1, 2011

(54) ITEM HANDLING SYSTEM WITH TRACKING

(75) Inventors: Russell W. Holbrook, Southbury, CT (US); Daniel J. Williams, Woodbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 34 days.

(21) Appl. No.: 12/613,085

(22) Filed: Nov. 5, 2009

(65) Prior Publication Data

US 2011/0103928 A1 May 5, 2011

(51) Int. Cl.
*B31B 1/08* (2006.01)

(52) U.S. Cl. ..... 493/13; 493/18; 493/187; 53/76

(58) Field of Classification Search ..... 53/76, 128.1, 53/131.2, 410, 411; 493/13, 14, 17, 18, 187, 493/188

See application file for complete search history.

(56) References Cited

U.S. PATENT DOCUMENTS 4,739,606 A * 4/1988 Cantile ..... 53/493
5,135,317 A * 8/1992 Greenwood et al. ..... 400/54
5,250,988 A * 10/1993 Matsuura et al. ..... 399/42
5,302,973 A * 4/1994 Costanza et al. ..... 347/233
5,641,054 A * 6/1997 Mori et al. ..... 198/619
5,687,641 A * 11/1997 Williamson et al. ..... 99/450.2
6,382,850 B1 * 5/2002 Freund et al. ..... 400/118.2
6,407,678 B1 * 6/2002 Elgee et al. ..... 341/8
6,607,458 B2 * 8/2003 Downing et al. ..... 474/102
2008/0218576 A1 * 9/2008 Phillips et al. ..... 347/104
2010/0219046 A1 * 9/2010 Williams et al. ..... 198/617

* cited by examiner

*Primary Examiner* — Rinaldi Rada
*Assistant Examiner* — Eyamindae Jallow
(74) *Attorney, Agent, or Firm* — Brian A. Collins; Charles R. Malandra, Jr.; Steven J. Shapiro

(57) ABSTRACT

An item handling system includes a vacuum source, a transport element defining a plurality of vacuum openings in fluid communication with the vacuum source to create a securing force on an item proximate to the transport element for holding the item in contact with the transport element, and a drive element for driving the transport element to transport the item. The transport element further defines a plurality of sensor openings arranged in two substantially parallel arrays along a longitudinal direction of the transport element. The system further includes a sensor associated with each array of sensor openings for sensing energy passing through the sensor openings to thereby sense the item on the transport element. Each sensor is disposed at a common longitudinal position relative to the transport element. Sensing the item corresponds to a condition where the sensor associated with each array is blocked.

11 Claims, 3 Drawing Sheets

ITEM HANDLING SYSTEM WITH TRACKING

FIELD OF THE INVENTION

The invention relates to system and method for handling items and, more particularly, to an item handling system having the capability to track items in the system.

BACKGROUND OF THE INVENTION

Item handling systems, such as mail piece handling systems, for example, are known in the art. These systems include inserter systems, sortation systems, and document transports. Inserter systems generally create mail pieces and prepare them for mailing. Sortation systems sort completed mail pieces by a designated parameter, such as delivery address, for example, and deposit the mail pieces in a respective pocket or bin. Document transports move documents between processing devices. Other types of item handling systems and related applications are known.

In some handling systems, documents are transported using belts or chain drives between stations where they undergo various types of processing. The processing may include cutting, folding, scanning, weighing, printing, and labeling, for example.

Some of the processing steps require that a document be maintained in a particular orientation or at a particular distance from a processing element. In one example, a scanning device may require a particular alignment or offset distance between the document and the device. In another example, certain printing devices, such as inkjet printers, for example, require a constant offset with respect to the document to ensure printing integrity.

In addition, many of the processing steps require precise knowledge of the location of the document. For example, labeling devices and/or printers require information regarding a document's location in order to apply a label or an image in a desired location on the document.

In those cases, the control of the document provided by the transport belts or chains may affect the ability to properly orient and register the document for processing. Moreover, conventional sensors for determining a document's location may require the use of transport systems that provide holding forces that are insufficient to properly maintain documents on the transport element during transport.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to an item handling system comprising a vacuum source, a transport element, and a drive element for driving the transport element to transport the item. As used herein, "items" include papers, documents, postcards, brochures, enclosures, booklets, magazines, and media items, including CDs, DVDs, computer disks, and/or other digital storage media.

The transport element may define a plurality of vacuum openings in fluid communication with the vacuum source to create a securing force on an item proximate to the transport element for holding the item in contact with the transport element. The transport element may further define a plurality of sensor openings arranged in two substantially parallel arrays along a longitudinal direction of the transport element.

The item handling system may further comprise a sensor associated with each array of sensor openings for sensing energy passing through the sensor openings to thereby sense the item on the transport element. Each sensor may be disposed at a common longitudinal position relative to the transport element. Sensing the item may correspond to a condition where the sensor associated with each array is blocked.

In another aspect, the invention relates to a method of handling an item, comprising placing a plurality of vacuum openings of a transport element in fluid communication with a vacuum source to create a securing force on an item proximate to the transport element for holding the item in contact with the transport element. The transport element may further define a plurality of sensor openings arranged in two substantially parallel arrays along a longitudinal direction of the transport element.

The method may further comprise driving the transport element with a drive element to transport the item and sensing energy passing through the sensor openings using a sensor associated with each array to thereby sense the item on the transport element. Each sensor may be disposed at a common longitudinal position relative to the transport element. Sensing the item may correspond to a condition where the sensor associated with each array is blocked.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 1:
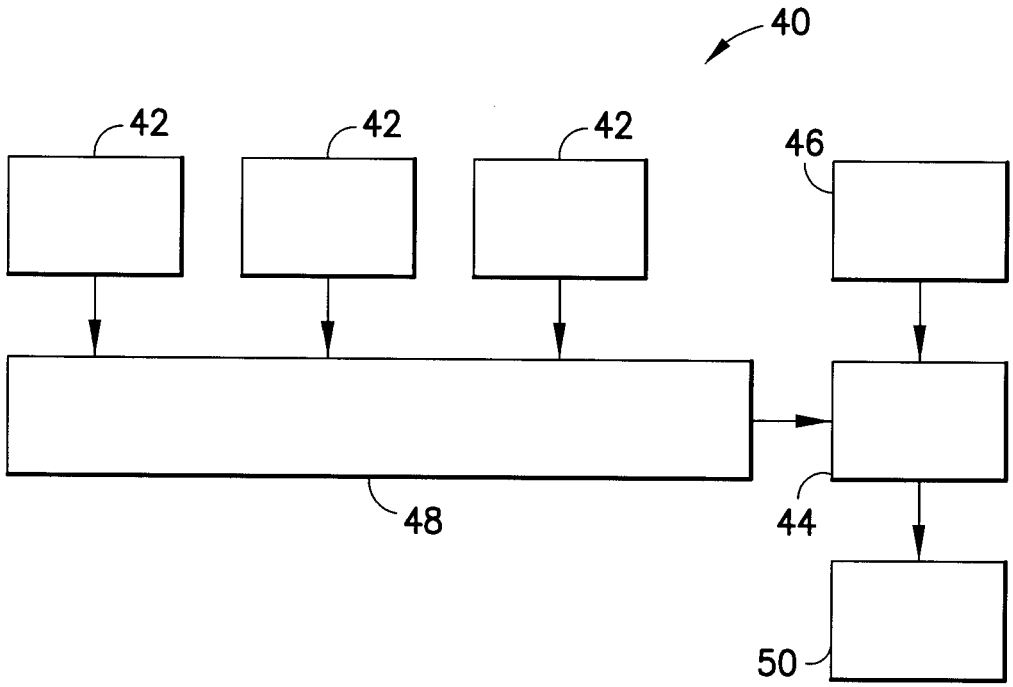
FIG. 1 is a schematic view of an apparatus comprising features of the invention.

Referring to FIG. 1, there is shown a diagram illustrating an apparatus 40 incorporating features of the invention. Although the invention will be described with reference to the example embodiment shown in the drawings, it should be understood that the invention can be embodied in many alternate forms of embodiments. In addition, any suitable size, shape, or type of elements or materials could be used.

In the illustrated embodiment, the apparatus 40 comprises an inserter configured to insert mail pieces, e.g., documents, into envelopes. As discussed above, embodiments of the invention may be used with a range of other items. Accordingly, the term "documents" is used interchangeably with "items" herein. Moreover, embodiments of the invention may also have applications in mail and document handling devices additional to inserters.

The inserter 40 generally comprises document supply units 42, an insertion station 44, an envelope supply unit 46, an item transport system 48, and an output 50. The document supply units 42 can each hold a supply of similar or dissimilar documents 16. In some embodiments, the supply may be arranged as a stack. The documents 16 may be mail piece inserts or mail piece documents, for example.

The item transport system 48 is adapted to transport documents from the document supply units 42 to the insertion station 44 for insertion into an envelope at the insertion station 44. In one embodiment, the assembly of the documents from each of the document supply units 42 into a stacked assembly occurs on the item transport system 48. After the documents are inserted into the envelope at the insertion station 44, the envelope is then sent to the output 50.

Referring also to FIGS. 2-5, the item transport system 48 includes a printing system for personalizing at least one of the documents from the document supply units 42 before insertion into the envelope at the insertion station 44. The item transport system 48 comprises a vacuum source 22, a transport element 52, rollers 18, 19, a print head 24, through beam detectors 54/56, and a controller 58. The transport element 52 may comprise a belt comprising a variety of materials and having a range of surface finishes. Examples of belt materials include fabrics, rubber and/or other synthetic compounds, and combinations thereof. Other transport elements may also be used. Accordingly, the term "belt" is used interchangeably with "transport element" herein.

Figure 4:
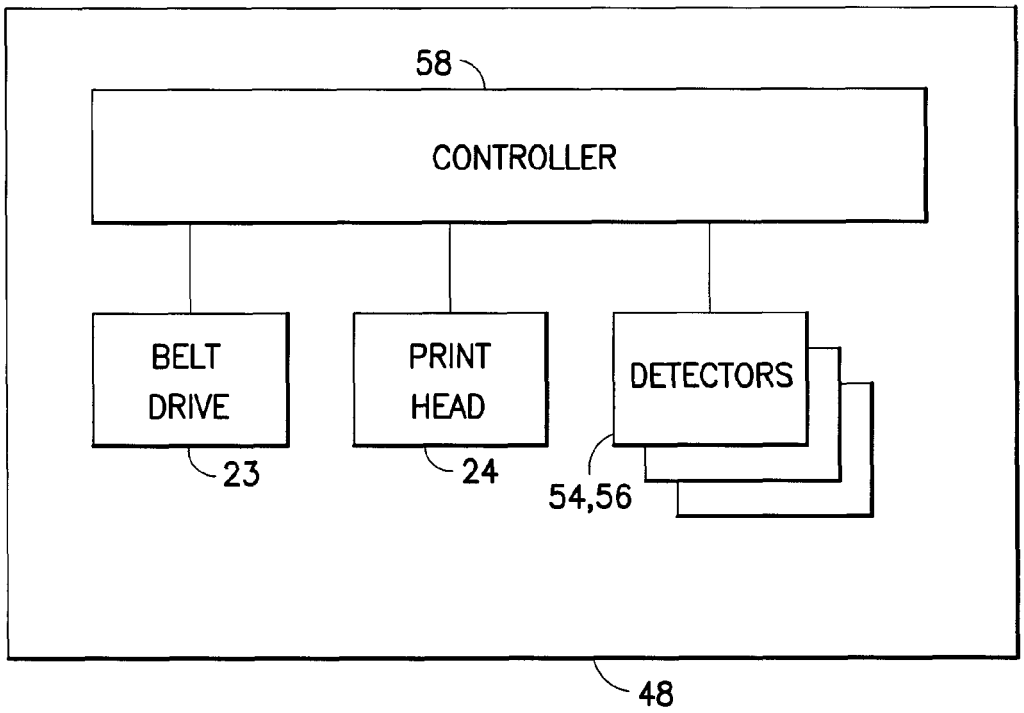
FIG. 4 is a schematic view of several components of the item transport system shown in FIG. 2.

One or both of the rollers 18, 19 are driven by a drive element, identified as a belt drive 23 in FIG. 4. The belt drive 23 may comprise a motor or other drive element.

Figure 5:
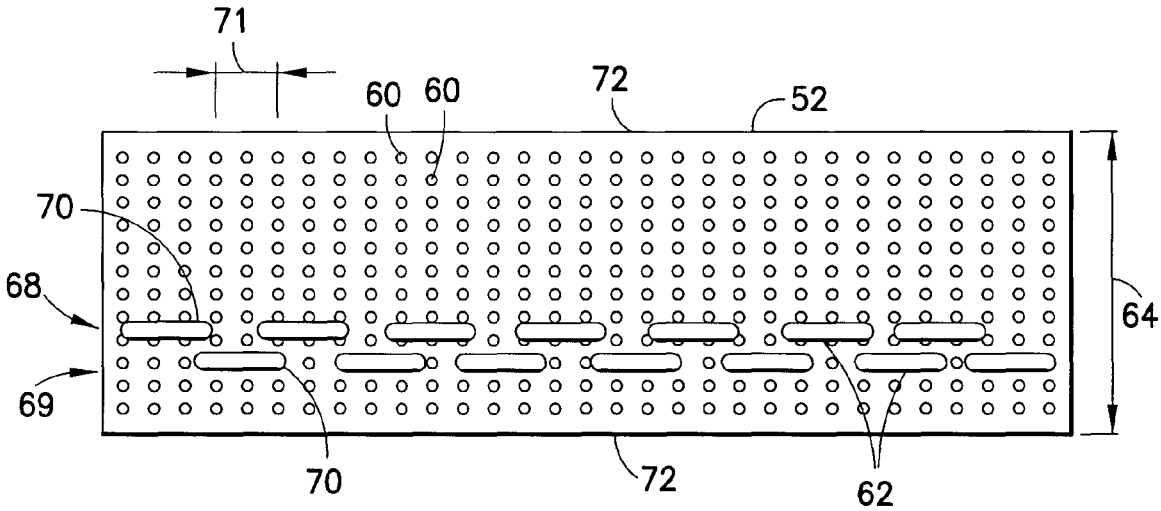
FIG. 5 is a top plan view of the transport element shown in FIGS. 2-3.

As seen best in FIG. 5, the belt 52 is a one-piece continuous belt defining a plurality of openings. The openings comprise vacuum openings 60 and sensor openings 62. The vacuum openings 60 extend across substantially the entire width and length of the belt 52, such as arranged in an array of rows across the width 64 and columns along the length. The first run 66 of the belt 52, between the rollers 18, 19, is located against the top of the deck 21 in sliding engagement. The belt 52 is in fluid communication with the vacuum source 22 to allow a vacuum holding force against the document 16 through the vacuum openings 60 to hold the document 16 against the top side of the belt 52.

The sensor openings 62 are larger than the vacuum openings 60 and have an elongate, i.e., oblong shape. The sensor openings 62 are intermixed among at least some of the vacuum openings 60. In this embodiment, the sensor openings 62 are arranged in two arrays 68, 69 along the longitudinal length of the belt 52. The leading edges 70 of the sensor openings 62 in the first array 68 are longitudinally offset 71 relative to leading edges 70 of the sensor openings in the second array 69. Due to the arrangement of the two arrays 68, 69, there is always at least one of the openings 62 at any single length of the belt 52, so at least one of the detectors 54/56 is always aligned with one of the openings 62.

In this embodiment the sensor openings 62 are spaced inward from outer lateral edges 72 of the belt 52. The two arrays form a first column of the sensor openings adjacent a second column of the sensor openings, wherein the second column of sensor openings is partially longitudinally offset from the first column of sensor openings.

The detector 54/56 is a through beam sensor, generally comprising at least one energy transmitter 54 and at least one sensor 56. The respective transmitters 54 are disposed on opposite sides of the belt 52 relative to the corresponding sensors 56. In this embodiment, the transmitters 54 are located in the area 74 between the first and second runs of the belt 52, and the sensors 56 are located above the top side of the belt 52 at the first run 66. The first and second runs of the belt correspond to top and bottom runs, respectively, because the item transport system 48 is shown in a horizontal arrangement in the drawings. Other arrangements may also be used.

Figure 2:
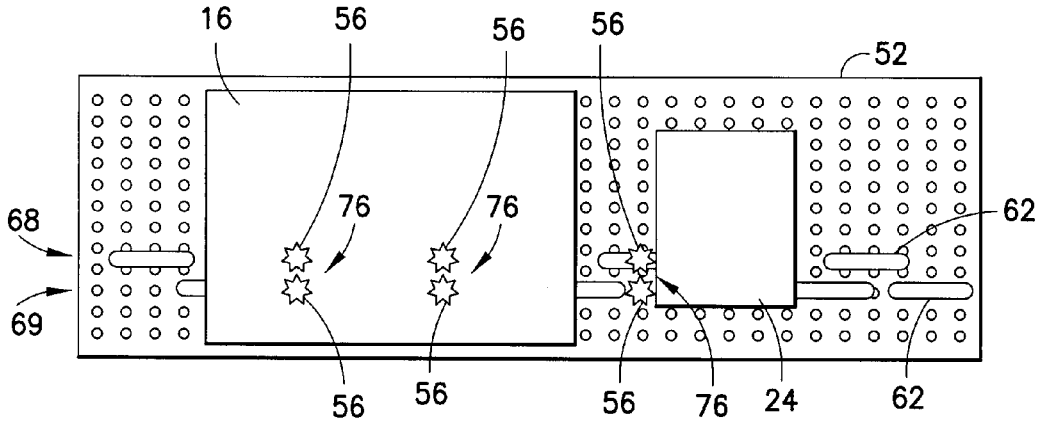
FIG. 2 is a top plan view of a portion of the item transport system shown in FIG. 1.
Figure 3:
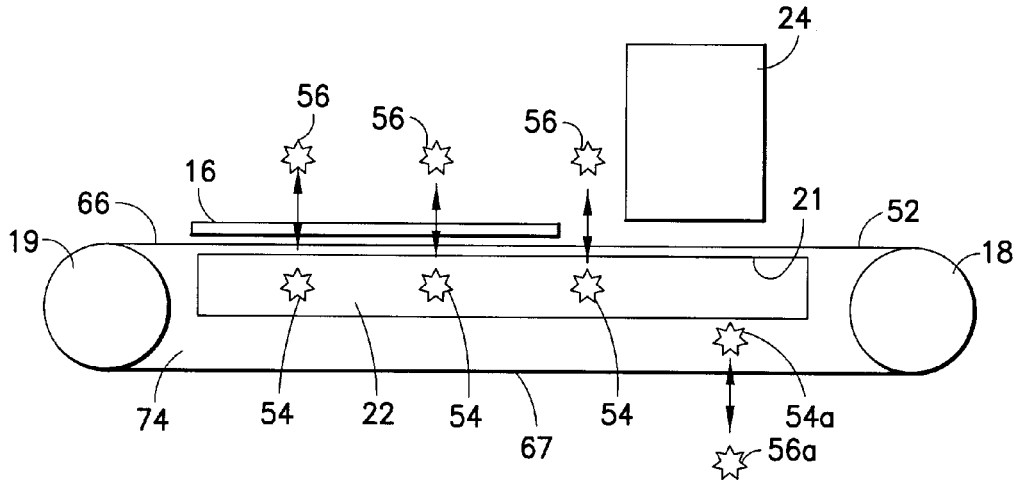
FIG. 3 is a side view of the portion of the item transport system shown in FIG. 2.

As illustrated best in FIG. 2, the detectors 54/56 are provided in pairs 76. The pairs 76 are at longitudinally spaced locations along the belt 52. In the illustrated embodiment, the transport system 48 also includes a detector 54*a*/56*a* at the second run 67 of the belt 52 (bottom, as shown in FIG. 3). Thus, pairs of the detectors are located on a first run of the belt, and a pair of the detectors is located on a second run of the belt. The additional bottom side through beam photocell detector 54*a*/56*a* can sight through belt slots to track the position of the belt as it passes by, without regard for whether or not a document is located on the belt, or if the document blocks all three top detector pairs 76.

The print head 24 is configured to print on the document 16. The document transport belt 52 is configured to move the document 16 to the print head 24. The print head 24 is connected to the controller 58 such that the controller 58 controls printing by the print head. The detectors 54/56 are connected to the controller 58. The detectors 54/56 are adapted to determine the location of the document 16 on the belt 52 and signal the controller 58. The controller comprises a processor and a memory which, based upon signals from the detectors 54/56, can determine when the document is located at the print head 24 for precise location printing by the print head on the document.

In some applications, users of mail piece inserters may require personalization of the documents they print, insert, and mail to customers. To personalize documents, "on-demand" printing is utilized on the inserting system. According to embodiments of the invention, a vacuum transport is utilized to ensure that there is no slippage between the document and the transport. The illustrated embodiments utilize a transport having a single wide vacuum belt 52 for flexibility and design robustness, provided with through beam photocells. This arrangement may provide reliable document tracking everywhere in an inserter system.

Embodiments of the invention may have applicability in a variable thickness vacuum printing base for an inserter, utilizing a full width belt and through beam sensors. Optionally, the oblong shapes of the sensor openings 62 may be slots cut in the belt at manufacture. FIG. 2 shows a top view of a transport with slotted belt and the detectors 54/56 (the through beam sensors) sighting through openings in the deck 21.

In some embodiments, through beam sensor pairs 76 may be used in sets side-by-side. Because the slots 62 in the belt are staggered, one of the detectors of each pair 76 can always sight through the belt 52 and deck 21 to determine the presence or absence of a document at that location. This geometry and pairing of sensors enables use of the through beam sensors with a full width belt, which was previously unavailable.

The belt 52 is configured so as not to block both of the detectors of the pair at that location simultaneously. Both detectors of the pair will be blocked only upon the arrival of the leading edge of a document on the belt 52. The position of that leading edge may be tracked as subsequent, downstream sensor pairs 76 are blocked by the arrival of the document's leading edge.

The securing force on the documents provided by the full width belt may allow improved accuracy of the text or images to be printed on the documents by the printer associated with the system. Such accuracy is more significant for color printing, as alignment among the four colors that make up the image is directly related to image quality. Thus, embodiments of the invention may provide improved document sensing using the through beam detectors, while providing secure transport of the documents using the single full width belt design.

With embodiments of the invention, a method of transporting a document can be provided comprising holding the document against a belt by a vacuum force extending through multiple vacuum openings arranged across a length and a width of the belt. The method can include sensing location of the document on the belt as the document is moved by the belt. Radiant energy from the transmitters 54 can be sent towards the belt located opposite a first side of the belt. The belt can comprise sensor openings 62 which are adapted to allow the radiant energy to pass through the belt at the sensor openings. A sensor 56 on an opposite second side of the belt can sense when the radiant energy is blocked from passing through one of the sensor openings by presence of the document 16 at least partially over the blocked sensor opening.

Embodiments of the invention further relate to a system, comprising a document transport belt 52 having an array of vacuum openings 60 across a width 64 and a length of the belt, wherein the belt further comprises sensor openings 62 along the length of the belt interspersed with the vacuum openings. The sensor openings 62 can comprise a first array 68 of the sensor openings and a second array 69 of the sensor openings. The sensor openings in the first array 68 are partially longitudinally offset 71 relative to the sensor openings in the second array 69. For each of the first and second arrays of sensor openings, an energy transmitter 54 and an energy sensor 56 can be located on respective opposite sides of the belt such that energy from at least one of the transmitters can pass through at least one of the sensor openings 62 to at least one of the sensors except when blocked by a document on the belt.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An item handling system, comprising:

a vacuum source;

a transport element including a vacuum belt operative to transport an item along a direction of travel, the vacuum belt defining a plurality of vacuum openings in fluid communication with the vacuum source to create a securing force on an item proximate to the transport element for holding the item in contact with the vacuum belt, the vacuum belt further defining at least two arrays of elongate sensor openings disposed through the vacuum belt, each of the elongate sensor openings being substantially parallel to the direction of travel, furthermore, the elongate sensor openings of one array being staggered relative to the elongate sensor openings of another array along the direction of travel, a drive element for driving the transport element to transport the item; and a sensor associated with each array of sensor openings for sensing energy passing through the sensor openings and operative to sense the longitudinal position of the item on the transport element, wherein each sensor is disposed at a common longitudinal position relative to the transport element, and wherein the staggered arrangement of the elongate sensor openings facilitates sensing of the item at the common longitudinal position irrespective the relative position of the sensed item and the transport element.

2. The system of claim 1, wherein the sensor openings are intermixed among at least some of the vacuum openings.

3. The system of claim 1, wherein the sensor openings are spaced inwardly from outer lateral edges of the transport element.

4. The system of claim 1, further comprising an energy transmitter corresponding to each sensor, wherein each sensor and corresponding transmitter are disposed on opposite sides of the transport element.

5. The system of claim 4, further comprising:

a plurality of sensors associated with each array of sensor openings; and an energy transmitter corresponding to each of the plurality of sensors.

6. The system of claim 5, wherein at least one of the plurality of sensors associated with each array of sensor openings is disposed proximate to a first run of the transport element, and wherein at least one of the plurality of sensors associated with each array of sensor openings is disposed proximate to a second run of the transport element.

7. The system of claim 1, wherein the transport element comprises a single continuous belt located between first and second rollers.

8. The system of claim 1, further comprising a print head configured to print on the item, wherein the transport element is configured to move the item to the print head.

9. The system of claim 8, further comprising an insertion station located downstream from the print head configured to insert the item into an envelope.

10. The system of claim 8, further comprising a controller connected to each sensor and the print head, wherein the controller is configured to control printing by the print head on the item based at least partially on a signal from each sensor.

11. The system of claim 1, wherein a first array of sensor opening and a second array of sensor openings are disposed in side-by-side relation.

* * * * *